US009663126B2

(12) United States Patent
Orion

(10) Patent No.: US 9,663,126 B2
(45) Date of Patent: May 30, 2017

(54) EMBEDDED SYSTEM FOR GENERATING A RAIL VEHICLE LOCATION SIGNAL

(71) Applicant: ALSTOM TRANSPORT TECHNOLOGIES, Levallois Perret (FR)

(72) Inventor: Jacques Orion, Vienne (FR)

(73) Assignee: ALSTOM Transport Technologies, Saint-Ouen (FR)

( * ) Notice: Subject to any disclaimer, the term of this patent is extended or adjusted under 35 U.S.C. 154(b) by 94 days.

(21) Appl. No.: 14/381,108

(22) PCT Filed: Mar. 5, 2013

(86) PCT No.: PCT/EP2013/054408
§ 371 (c)(1),
(2) Date: Aug. 26, 2014

(87) PCT Pub. No.: WO2013/135533
PCT Pub. Date: Sep. 19, 2013

(65) Prior Publication Data

US 2015/0025716 A1 Jan. 22, 2015

(30) Foreign Application Priority Data

Mar. 15, 2012 (FR) ..... 12 52327

(51) Int. Cl.
*B61L 25/02* (2006.01)
*B61L 3/12* (2006.01)

(52) U.S. Cl.
CPC ..... *B61L 25/02* (2013.01); *B61L 3/12* (2013.01); *B61L 3/121* (2013.01); *B61L 25/025* (2013.01)

(58) Field of Classification Search
None
See application file for complete search history.

(56) References Cited

U.S. PATENT DOCUMENTS 4,550,444 A * 10/1985 Uebel ..... B61L 25/043 246/167 R
6,963,301 B2 * 11/2005 Schantz ..... H04B 5/0075 342/118

(Continued)

FOREIGN PATENT DOCUMENTS

EP 1 227 024 A1 7/2002
EP 1 407 955 A1 4/2004

(Continued)

OTHER PUBLICATIONS

International Search Report of PCT/EP2013/054408, dated May 27, 2013. [PCT/ISA/210].

*Primary Examiner* — Rami Khatib
(74) *Attorney, Agent, or Firm* — Sughrue Mion, PLLC

(57) ABSTRACT

This system (210) comprises an antenna (20) comprising a first loop (22) and a second loop (24) having different radiation patterns, the first and second loops being designed to generate first and second currents (I1, I2) when the antenna passes over a beacon situated on the line and an electronic processing subsystem designed to generate a location signal from said first and second currents.
It is characterized by said subsystem being a first subsystem (230) for generating a first location signal (SL1), the system comprises a second subsystem (240) for generating a second location signal (SL2) from said first and second currents, and by said subsystem comprising an arbitration means (250) designed to generate a safety location signal (SLS) according to said first and second location signals.

21 Claims, 4 Drawing Sheets

(56) References Cited

U.S. PATENT DOCUMENTS

| | | | | |
|---|---|---|---|---|
| 7,023,346 | B2 * | 4/2006 | Balch | G06K 7/10316 340/10.1 |
| 8,026,790 | B2 * | 9/2011 | Fiz | B61L 3/121 340/3.31 |
| 2002/0121991 | A1 * | 9/2002 | Rostren | B61L 25/026 340/988 |
| 2006/0132317 | A1 * | 6/2006 | Letkomiller | A01K 11/006 340/573.1 |
| 2009/0231103 | A1 * | 9/2009 | Gobrecht | B61L 25/02 340/10.1 |
| 2009/0241014 | A1 * | 9/2009 | De Mareschal | G05B 9/03 714/824 |

FOREIGN PATENT DOCUMENTS

| | | | |
|---|---|---|---|
| EP | 2 181 908 | A2 | 5/2010 |
| FR | 2 928 602 | A1 | 9/2009 |
| WO | 2011/110882 | A1 | 9/2011 |

* cited by examiner

EMBEDDED SYSTEM FOR GENERATING A RAIL VEHICLE LOCATION SIGNAL

CROSS REFERENCE TO RELATED APPLICATIONS

This application is a National Stage of International Application No. PCT/EP2013/054408 filed Mar. 5, 2013, claiming priority based on French Patent Application No. 12 52327, filed Mar. 15, 2012, the contents of all of which are incorporated herein by reference in their entirety.

The field of the invention is that of the embedded systems for generating a rail vehicle location signal of the type comprising:

an antenna comprising a first loop and a second loop having different respective radiation patterns, the first and second loops being respectively designed to generate first and second currents when the antenna passes over a suitable beacon, situated on the line at a known position; and, an electronic processing subsystem designed to generate a location signal from said first and second currents.

The document EP 1 227 024 B1 discloses a system of the preceding type comprising an antenna intended to be installed onboard a train so as to cooperate with a beacon arranged on the line, the geometrical center of the beacon having a known geographic position.

The antenna comprises two planar loops superposed on one another in a substantially horizontal plane.

The first loop is simple. It consists of a metal wire forming a single turn, that is to say not including any twist. This first loop is substantially ellipsoid, with the large axis oriented in the longitudinal direction of movement of the train.

The second loop, in a FIG. 8, consists of a metal wire forming a turn twisted on itself. The geometrical center of the second loop, which is the point of intersection of the wire on itself, coincides with the geometrical center of the first loop and constitutes the center of the antenna. The axis of symmetry of the second loop according to the large dimension thereof is oriented along the longitudinal axis of movement of the train.

During the movement of the train, the antenna passes over the beacon and passes through a magnetic field generated by said beacon. The magnetic field induces a first electric current in the first loop and a second electric current in the second loop. When the induced currents are detectable, the antenna is said to be in contact with the beacon.

The sign of the intensity of the current induced in the loop, also called "the phase" of this induced current, changes according to the position of the antenna relative to the center of the beacon.

Since the first and second loops have different forms, they have different radiation patterns. Because of this, the trend of the phase of the first induced current is different from that of the phase of the second induced current.

The antenna is equipped with an electronic processing subsystem designed to follow the trend of the amplitude of the first current relative to a threshold value and the trend of the difference between the phases of the first and second induced currents when the antenna is moved over the beacon. This subsystem generated at the output a location signal, the instant of transmission of which indicates the passing of the center of the antenna directly over the center of the beacon.

The functional accuracy of the processing subsystem is such that the location signal is transmitted at +/−2 cm from the center of the beacon.

The document PCT/FR2010/050607 widens the teaching of the preceding document by proposing the use of an antenna comprising a third planar loop superposed on the first and second simple and FIG. 8 loops. This third loop consists of metal wires forming a turn comprising two twists. The two points of interleaving of the wire are arranged in the longitudinal direction of movement of the train. The mid-point between these two interleaving points is situated longitudinally slightly in front of (or behind) the center of the antenna.

The radiation pattern of this third loop is specific to it.

The antenna is equipped with an electronic processing subsystem designed to follow the correlation between the trend of the difference between the phases of the first and second currents, the trend of the difference between the phases of the first and third currents, and the trend of the difference between the phases of the second and third currents. This subsystem generates at the output a location signal, the instant of transmission of which indicates the passing of the center of the antenna directly over the center of the beacon. The functional accuracy is also +/−2 cm from the center of the beacon. The advantage of this antenna with three loops lies in the increased volume of contact of the antenna and the beacon, which makes it possible to relax the constraints of installation of the beacon on the line and of the antenna on the train.

The processing subsystem designed to perform this correlation and consequently generate a location signal, has a functional accuracy of +/−2 cm relative to the center of the beacon.

The location information concerning a rail vehicle on the network is a functionally important data item. For the example of a subway, the location information makes it possible to know the exact position of a set of coaches relative to the platform of a station, so as to stop the set of coaches facing platform doors so that the passengers can step out of and into the set of coaches.

If the location information is incorrect, the platform doors may be opened even though the doors of the set of coaches are not facing the platform doors. This can have serious consequences in terms of safety for the passengers.

Other examples could be described demonstrating that the location information is a sensitive data item.

Now, the prior art does not take into account the possible failure of the processing subsystem in the generation of the location signal.

The aim of the invention is therefore to overcome this problem, by proposing in particular a secure system for generating a location signal, in which a malfunction in the generation of the location signal can be identified, so that the location signal that is generated is reliable, that is to say conforms to the safety level SIL 4 defined by the standard IEC 61508.

To this end, the subject of the invention is an embedded system for generating a rail vehicle location signal of the abovementioned type, said subsystem being a first subsystem designed to generate a first location signal, the system comprises a second electronic processing subsystem designed to generate a second location signal from said first and second currents, and the system also comprises an arbitration means designed to generate a safety location signal according to said first and second location signals.

According to particular embodiments, the system comprises one or more of the following features, taken in isolation or in all technically possible combinations:

said first and second subsystems are independent of one another;

said first and second subsystems are identical to one another;

the arbitration means selects, as safety location signal, the signal that arrived second in time out of the first and second location signals transmitted first in time by each of the first and second subsystems;

the arbitration means takes as input a distance delivered by an odometer system with which said vehicle is equipped, and the arbitration means selects the signal that arrived second in time if it arrives at a point which is at a distance from the point of transmission of the signal transmitted first in time less than a reference distance, notably equal to 5 cm;

the antenna comprises a third loop, the radiation pattern of which is different from that of the second loop and from that of the first loop, said safety location signal making it possible to locate the vehicle relative to the known position of the beacon with an accuracy of −2/+7 cm;

the system comprises a third electronic processing subsystem designed to generate a third location signal from said first and second currents, said arbitration means being designed to select, as safety location signal, the location signal transmitted second in time out of the first, second and third location signals transmitted first in time by each of the first, second and third subsystems;

the arbitration means is designed to determine, for each of the subsystems, a "before" duration separating the instant of the start of detection of the beacon and the instant of transmission of the location signal transmitted first in time by the subsystem concerned, and an "after" duration separating the instant of transmission of the location signal transmitted first in time by the subsystem concerned and the instant of the end of detection of the beacon, and the arbitration means comprises a means designed to identify the failure of a subsystem if the ratio of the "before" duration to the "after" duration is outside of a predetermined interval around the unity value;

the first subsystem comprises a first analog part and a first digital part, the second subsystem comprises, as second analog part, said first analog part of the first subsystem, and a second digital part independent of said first digital part of the first subsystem;

the second digital part of the second subsystem is identical to the first digital part of the first subsystem;

the arbitration means selects, as safety location signal, the location signal that arrived second in time out of said first and second location signals transmitted first in time by each of the first and second subsystems, provided that the duration separating the transmission of the location signals transmitted first in time by each of the subsystems is less than a reference duration, notably equal to 1.5 μs;

the antenna comprising a third loop, the radiation pattern of which is different from that of the second loop and from that of the first loop, said safety location signal makes it possible to locate the vehicle relative to the known position of the beacon with an accuracy of +/−5 cm, preferably +/−2 cm; and each subsystem comprising an analog part and a digital part, the system comprises a test means designed to apply a reference current to an input of an analog part and to analyze digitized current signals generated at the output of said analog part or of another analog part;

the system complies with the safety level SIL 4.

Another subject of the invention is a rail vehicle comprising such an embedded system for generating a location signal.

The final subject of the invention is a method for generating a rail vehicle location signal, comprising the steps consisting in:

generating first and second currents when an antenna passes over a suitable beacon, said antenna being embedded onboard the vehicle and comprising a first loop and a second loop having different respective radiation patterns, said beacon being situated on the line at a known position;

generating a location signal from said first and second currents;

said location signal being a first location signal transmitted by a first processing subsystem of the first and second currents, the method consists in:

generating a second location signal from said first and second currents by means of a second processing subsystem; and, generating a safety location signal according to said first and second location signals.

According to particular embodiments, the method comprises one or more of the following features, taken in isolation or in all technically possible combinations:

the generation of a safety location signal consists in selecting, as safety location signal, the location signal that arrived second in time out of the first and second location signals transmitted first in time by each of the first and second processing subsystems, provided that the distance separating the location signal that arrived second in time from the location signal that arrived first in time is less than a predetermined reference distance;

the method comprises the step consisting in generating a third location signal from said first and second currents by means of a third processing subsystem; and the generation of a safety location signal consists in selecting, as safety location signal, the location signal that arrived second in time out of the location signals transmitted first in time by each of the three processing subsystems respectively;

the first subsystem comprising a first analog part and a first digital part, the second subsystem comprising, as second analog part, said first analog part of the first subsystem, and a second digital part independent of said first digital part of the first subsystem, the generation of a safety location signal consists in selecting, as safety location signal, the location signal that arrived second in time out of the location signals transmitted first in time by each of the two processing subsystems, provided that the duration between the instants of transmission of the first and second signals is less than a predetermined reference duration; and the method also comprises the verification of at least one additional condition making it possible to detect a failure of the analog part common to the first and second processing subsystems.

The invention and its advantages will be better understood on reading the following description, given solely as an example, and with reference to the attached drawings in which.

FIRST EMBODIMENT

Figure 1:
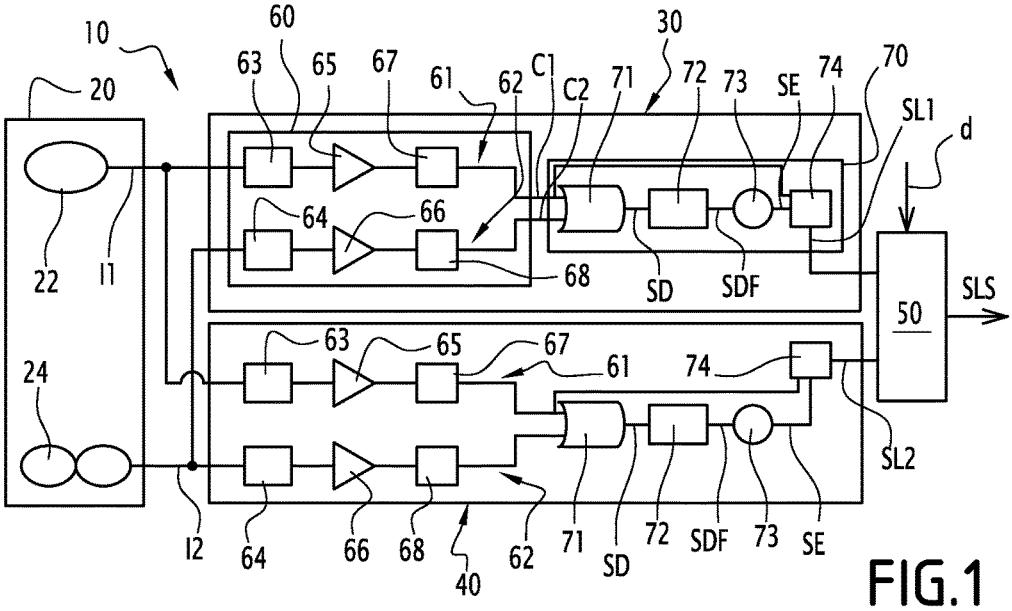
FIG. 1 represents a first embodiment of an embedded system for generating a location signal.
Figure 2:
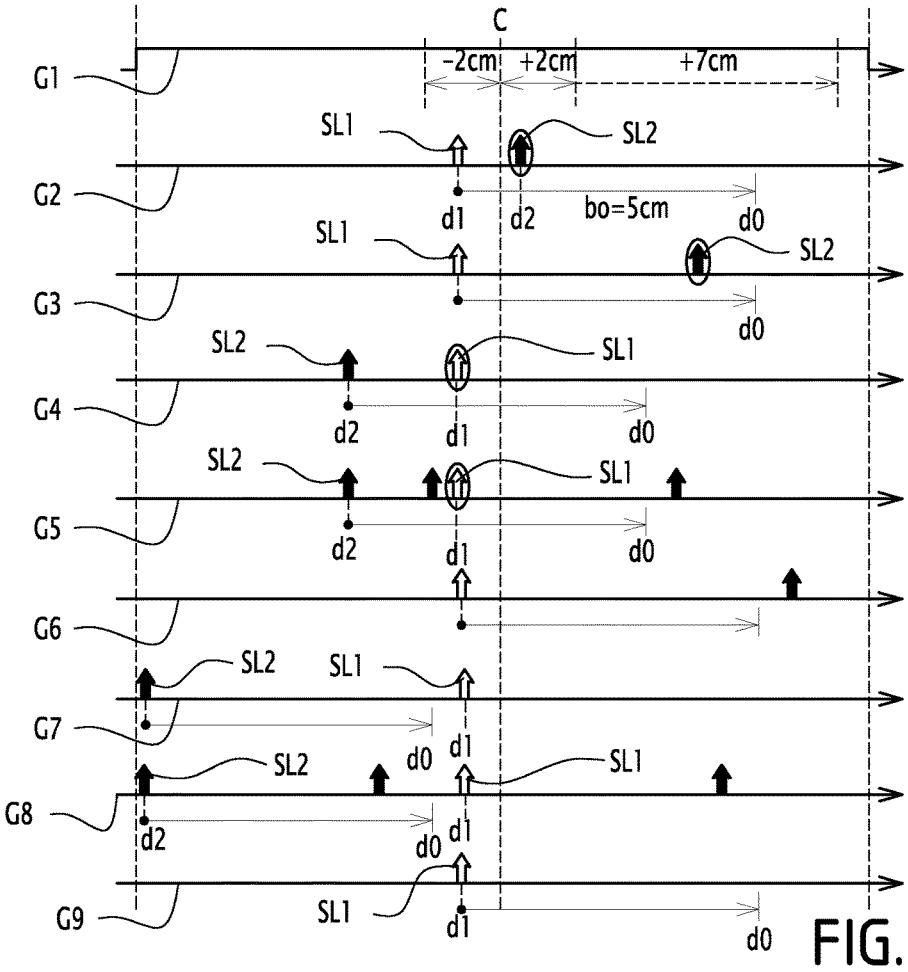
FIG. 2 represents a number of graphs illustrating the operation of a first arbitration algorithm implemented by the system of FIG. 1.

FIGS. 1 and 2 relate to a first embodiment of a system for generating a rail vehicle location signal intended to be installed in a vehicle such as a train, a subway or a tramway.

The system 10 according to this first embodiment comprises an antenna 20, two electronic processing subsystems, respectively 30 and 40, and an arbitration means 50.

The antenna 20, like the antenna of the prior art described previously, comprises two loops having different radiation patterns: a first simple loop 22 designed to deliver a first induced current I1, and a second FIG. 8 loop 24 designed to deliver a second induced current I2.

The system comprises a first electronic processing subsystem 30 designed to deliver a first location signal SL1 from the first and second induced currents I1, I2 which are applied to it as input.

The first subsystem 30 is identical to the one used in the prior art.

The first subsystem 30 comprises an analog part 60 and a digital part 70.

The analog part 60 comprises a first analog circuit 61 for shaping the first induced current I1 and a second analog circuit 62 for shaping the second induced current I2.

The first circuit 61, designed for the generation of a first digitized current C1 from the first induced current I1, comprises, in succession, a filter 63, for filtering the induced current I1 at the output of the corresponding loop; an amplifier 65, for amplifying the filtered current; and an analog/digital converter 67 for digitizing the amplified current and generating, at the output, a digitized current C1.

The second circuit 62, designed for the generation of a second digitized current C2 from the second induced current I2, is identical to the first circuit. It comprises, in succession, a filter 64, an amplifier 66 and an analog/digital converter 68.

The digital part 70 of the first processing subsystem, is designed to generate the first location signal SL1 from the first and second digitized currents C1, C2 which are applied to it as input. The digital part 70 comprises, in succession, a phase comparator, a filter, a hysteresis threshold comparator and a unit for generating a location signal.

The phase comparator 71 compares the phases of the first and second digitized currents C1, C2 which are applied to it as input, and generates at the output a phase difference signal SD, the value of which is +1 when the phases of the first and second digitized currents are identical and −1 when these phases are opposite.

The filter 72 takes as input the phase difference signal SD and generates at the output a filtered phase difference signal SDF, with a value within the interval [−1, 1]. The function of the filter is to perform a time averaging, over a predefined time window, of the phase difference signal SD.

The hysteresis threshold comparator 73 takes as input the filtered phase difference signal SDF and compares it to a band of prohibited values. The threshold comparator generates at the output a status signal SE which changes from 0 to 1 when the filtered phase difference signal SDF goes above the greatest value of this band; and from 1 to 0 when the filtered phase difference signal SDF goes below the smallest value of this band.

Finally, the location signal generation unit 74 takes as input the first digitized current signal C1 and the status signal SE and generates the location signal SL.

The unit 74 comprises a threshold comparator designed to compare the level of the current C1 to a reference level and to generate a binary signal of unity value as soon as the current C1 exceeds the reference level. The unit 74 also comprises a logic element designed to generate a location signal SL as soon as the signals transmitted by the threshold comparator of the unit 74 and the hysteresis threshold comparator 73 both equal unity. The location signal SL transmitted takes, for example, the form of a pulse of a value equal to unity.

The system 10 comprises a second electronic processing subsystem 40 for the first and second induced currents I1, I2 in order to generate a second location signal SL2.

The second subsystem 40 is independent of the first processing subsystem 30.

The second subsystem 40 is identical to the first processing subsystem 30. It comprises electronic circuits and components identical to those of the first processing subsystem. This is why, in FIG. 1, the elements that are identical between the first subsystem and the second subsystem are identified by the same reference numerals.

The system 10 comprises an arbitration module 50 designed to deliver at the output a safety location signal SLS. This module takes as input the first and second location signals SL1, SL2 generated respectively at the output of the first and second subsystems 30, 40, as well as a data item indicating the distance d traveled since a reference point delivered by an odometer system with which the vehicle is equipped.

More specifically, the arbitration module implements a first algorithm consisting in selecting, as safety location signal SLS, the location signal that arrived second in time out of the first and second location signals SL1, SL2 transmitted first in time by each of the first and second processing subsystems 30, 40, provided that the distance D separating the location signal that arrived second in time from the location signal that arrived first in time is less than a predetermined reference distance D0. The reference distance D0 is, preferably, 5 cm.

Even if the components used in the two subsystems 30 and 40 are identical, each of the first and second subsystems has its own sensitivity and its own signal-to-noise ratio.

Since the generation, by a subsystem, of a location signal SL is associated with a trend of phase of the second induced current I2, that is to say with the cancellation of the intensity of this current, the sensitivity difference between the two subsystems 30 and 40 translates into a distance traveled by the vehicle between the instants of transmission of the first and second location signals SL1, SL2.

By assuming that the speed of the vehicle is substantially constant when the antenna is in contact with the beacon, this distance corresponds to a time difference between the instants of transmission of the first and second location signals SL1, SL2. It should be noted that this time difference cannot be bounded because, the slower the vehicle, the greater the time difference between the instants of transmission of the first and second location signals.

In normal operation, each subsystem 30, 40 supplies a location signal with a functional accuracy of +/−2 cm from the center of the beacon.

Since the location signal is transmitted when there is a variation of the phase differences caused by a variation of the phase of the intensity induced in the second FIG. 8 loop of the antenna, the functional accuracy is exclusively due to the signal-to-noise ratio of the processing subsystem of this induced intensity.

However, in case of failure of one of the two subsystems, and since it is not possible to identify the subsystem which has failed, the location signal that should be taken into account out of the first and second location signals transmitted cannot be known.

Thus, the simple fact of duplicating the processing subsystem, that is to say ensuring a redundancy in the generation of the location signal, does not make it possible to locate the vehicle relative to the center of the beacon with certainty, that is to say safely.

The rail vehicles are, as is known per se, equipped with an odometer system which comprises a phonic wheel mounted on an axle and the movement of which makes it possible to determine the distance traveled d by the vehicle from a reference point situated along the line.

To detect the failed subsystem and limit the impact of this failure on the location function, according to this first embodiment, the odometer of the vehicle is used in order to supply the arbitration module 50 with a distance datum d enabling said module to determine the distance traveled by the vehicle between the instants of transmission of the location signals SL1 and SL2 transmitted first in time by each of the two subsystems.

FIG. 2 combines a number of graphs illustrating the behavior of the first algorithm in different situations, normal and failure of one of the processing subsystems, in this case the second processing subsystem 40.

In these graphs, d1 represents the point at which the first processing subsystem 30 transmits, for the first time, a first location signal SL1; d2 represents the point at which the second processing subsystem 40 transmits, for the first time, a second location signal SL2; and d0 represents the point which is distant from the signal transmitted first in time from the reference distance D0.

The graph G1 represents the spatial interval within which the antenna is in contact with the beacon. The geometrical center of the beacon is identified by the reference C.

The graph G2 illustrates normal operation of the system. In this graph, the location signal that arrived first in time is the first signal SL1 and the location signal that arrived second in time is the second signal SL2. The second signal SL2 is transmitted at d2 before the point d0 . Thus, the module 50 selects, as safety location signal SLS, the second signal SL2. In these figures, the signal selected as safety location signal by the selection module is circled. It will be observed that the point d2 is within an interval [−2 cm; +7 cm] around the point C.

For the subsequent graphs, the second subsystem 40 has failed. However, this has no impact because a safety location signal SLS is delivered by the system 10. This safety location signal is acceptable in as much as it allows for a correct location of the vehicle relative to the beacon within the interval [−2 cm; +7 cm] around the point C.

The graph G3 represents the case where the second location signal SL2 arrives too late relative to the intrinsic functional accuracy of a subsystem, that is to say +/−2 cm relative to the point C. It is, however, selected as safety location signal SLS by the arbitration module 50, because the point d2 is less than 5 cm from the point d1.

The graph G4 represents the case where the second location signal SL2 arrives too early relative to the intrinsic functional accuracy of a subsystem. In this case, the signal transmitted first in time is the second signal SL2. The first signal SL1 that arrived second in time, is then selected as safety location signal SLS by the arbitration module 50, because the point d1 is less than 5 cm from the point d2.

The graph G5 represents the case where the second location signal SL2 is transmitted a number of times, the first time too early relative to the intrinsic functional accuracy of a subsystem. In this case, the signal transmitted first in time is the second signal. The first signal SL1 which arrived second in time is then selected as safety signal SLS by the arbitration module 50, because the point d1 is less than 5 cm from the point d2.

For the subsequent graphs, the second subsystem 40 has failed. This failure can be identified so that no safety location signal SLS is delivered by the system.

The graph G6 represents the case where the second location signal SL2 arrives too late relative to the intrinsic functional accuracy of a subsystem. Although the second signal is the signal transmitted second in time, no safety location signal is transmitted by the arbitration module, because the point d2 is beyond the point d0 5 cm away from d1.

The graph G7 represents the case where the second location signal SL2 arrives too early relative to the intrinsic functional accuracy of a subsystem. Although the first signal SL1 arrived second in time no safety location signal is transmitted by the arbitration module, because the point d1 is beyond the point d0 5 cm away from the point d2.

Finally, the graph G8 represents the case where the second location signal SL2 arrives a number of times, the first time too early relative to the intrinsic functional accuracy of a subsystem. The first signal SL1 however that arrived second in time is not selected as safety signal SLS by the arbitration module 50, because the point d1 is beyond the point d0 5 cm away from the point d2.

The graph G9 represents the case where the second subsystem 40 delivers no second location signal SL2. No safety location signal SLS is then transmitted by the arbitration module 50.

Thus, by the implementation of the first algorithm, the system 10 generates a safety location signal making it possible to locate the vehicle with an accuracy of [−2 cm; +7 cm] relative to the center C of the beacon with a reliability of level SIL 4.

However, this accuracy is not assured when the axle on which the phonic wheel of the odometer system is mounted is a drive axle and/or a braking axle. The slippages, in traction mode or in braking mode, of this wheel of the axle generate an uncertainty on the distance actually traveled by the vehicle between the instants of transmission of the first and second location signals.

The following two embodiments of the system advantageously make it possible to address this problem by proposing systems which do not need the distance traveled datum delivered by the odometer to generate a safety location signal.

SECOND EMBODIMENT

Figure 3:
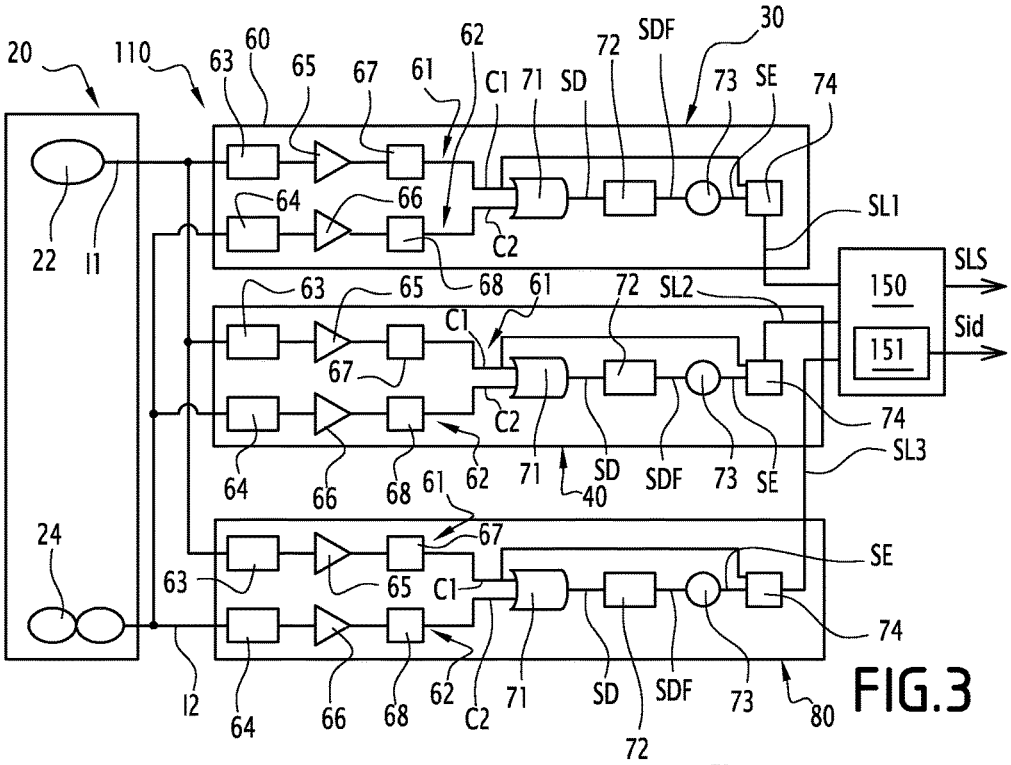
FIG. 3 represents a second embodiment of an embedded system for generating a location signal.
Figure 4:
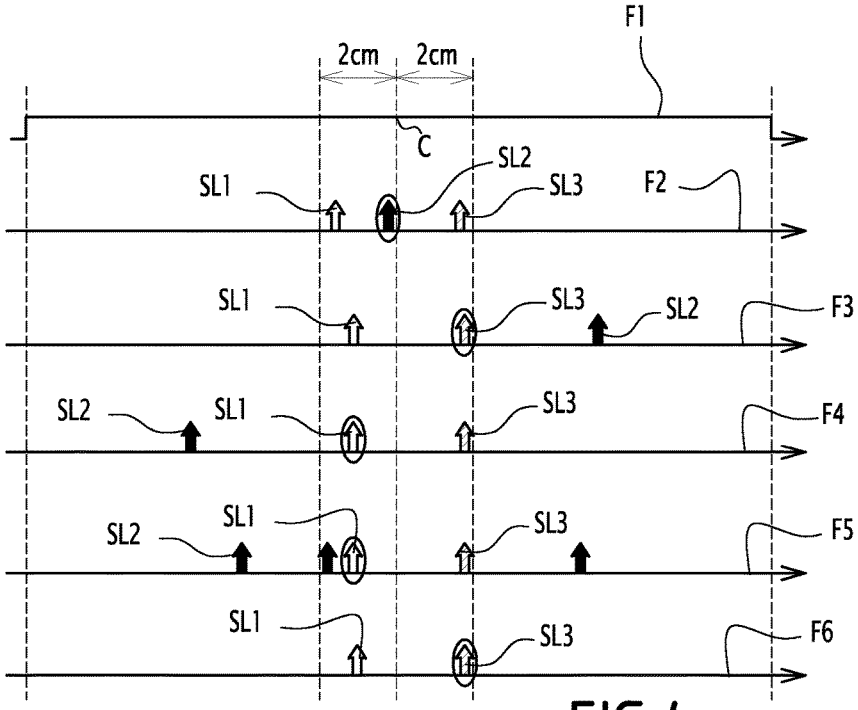
FIG. 4 represents a number of graphs illustrating the operation of a second arbitration algorithm implemented by the system of FIG. 3.

FIGS. 3, 4 and 5 relate to a second embodiment of the system.

An element of FIG. 3 which is identical to an element of FIG. 1 is designated in FIG. 3 by the reference numeral used in FIG. 1 to designate this corresponding element.

As represented in FIG. 3, the system 110 according to this second embodiment comprises an antenna 20 comprising first and second loops, respectively simple 22 and in a FIG. 8, 24, conforming to the prior art.

The system comprises, in addition to first and second processing subsystems 30 and 40, identical to those of the first embodiment, a third electronic processing subsystem 80 for the first and second induced currents I1 and I2, respectively by the first and second loops of the antenna, to generate a third location signal SL3.

The third processing subsystem 80 is independent of the first and second subsystems 30 and 40.

The third processing subsystem 80 is identical to the first and second subsystem. In particular, the circuits and the components of the third processing subsystem are identical to those of the first and second subsystem. This is why the reference numerals used to designate the components of the first and second subsystems have been reprised to designate the corresponding components of the third subsystem.

The system 110 comprises an arbitration module 150 designed to generate a safety location signal SLS from, only, first, second and third location signals SL1, SL2 and SL3 transmitted respectively by each of the three subsystems 30, 40 and 80.

The second algorithm implemented by the arbitration module consists in selecting, as safety location signal SLS, the location signal that arrived second in time out of the location signals SL1, SL2, SL3 transmitted first in time by each of the three processing subsystems 30, 40, 80 respectively.

As in the first embodiment, this second algorithm relies on the fact that a subsystem which is operating correctly supplies a location signal at +/−2 cm from the center C of the beacon, this being guaranteed by the different radiation patterns of the loops 22 and 24 of the antenna.

FIG. 4 combines a number of graphs illustrating the behavior of the second algorithm implemented by the module 150.

In these graphs, d1 represents the point at which the first processing subsystem 30 transmits, for the first time, a first location signal SL1; d2 represents the point at which the second processing subsystem 40 transmits, for the first time, a second location signal SL2; and d3 represents the point at which the third processing subsystem 80 transmits, for the first time, a third location signal SL3.

The graph F1 represents the spatial interval within which the antenna detects the beacon. The geometrical center of the beacon is identified by the reference C.

The graph F2 illustrates a normal operation of the system 110. In this graph, the first signal SL1 arrives first in time, the second signal SL2 arrives second in time and the third signal SL3 arrives third in time. The module 150 selects, as safety location signal SLS, the second signal SL2.

For the subsequent graphs, the second subsystem 40 has failed. However, this has no impact because a safety location signal is delivered by the system 110. This safety location signal is acceptable in as much as it allows for a correct location within the tolerance interval of +/−2 cm relative to the center C of the beacon.

The graph F3 represents the case where the second signal SL2 arrives too late relative to the intrinsic functional accuracy of +/−2 cm relative to the point C. The module 150 then selects the third location signal SL3 which is the signal that arrived second in time. The point d3 is less than 2 cm from the point C.

The graph F4 represents the case where the second signal SL2 arrives too early relative to the intrinsic functional accuracy. The module 150 then selects the first signal SL1 which is the signal that arrived second in time. The point d1 is less than 2 cm from the point C.

The graph F5 represents the case where the second signal SL2 is transmitted a number of times, the first time too early relative to the intrinsic functional accuracy of +/−2 cm relative to the point C. The first signal SL1 is then selected as safety signal SLS by the arbitration module 150, because it is actually the location signal that arrived second in time out of the location signals transmitted first in time by each of the three subsystems. The point d1 is less than 2 cm from the point C.

The graph F6 represents the case where the second subsystem 40 delivers no second location signal. However, the module 150 selects the third signal SL3 as safety location signal SLS, because it is the signal transmitted second in time. The point d3 is less than 2 cm from the point C.

Once the location relative to the point C has been performed, it is necessary to identify whether a subsystem has failed in order to guarantee compliance with the safety level SIL 4. Since the present method is tolerant to the failure of just one of the three subsystems, it therefore relies on the identification of a latent failure.

Figure 5A:
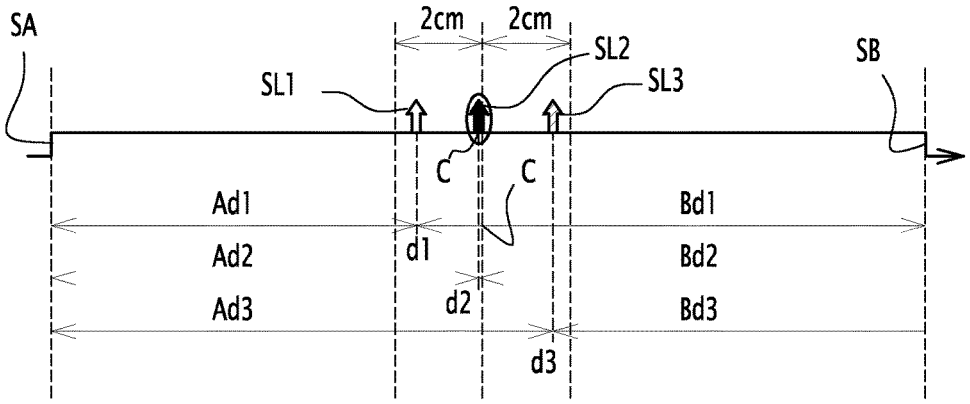
FIGS. 5A and 5B represent a number of graphs illustrating the determination of a ratio making it possible to detect failures in the system of FIG. 3.
Figure 5B:
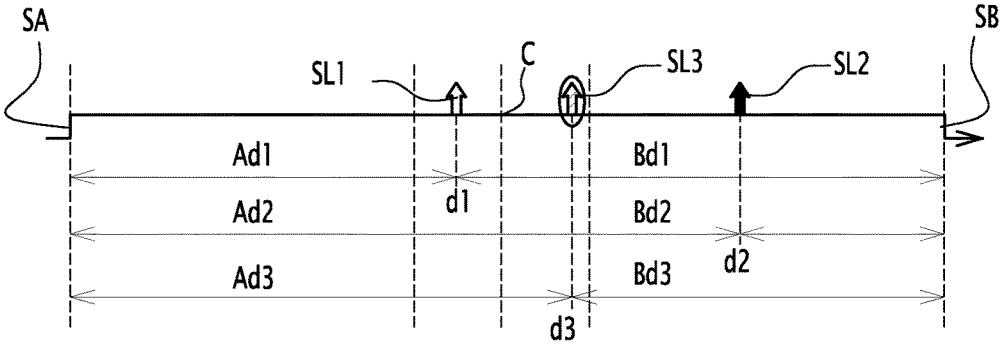

In particular, the failures that are "too late" (graph F3) or "too early" can be detected as is illustrated in FIGS. 5A and 5B. The distance "before" Adi is defined as the distance between the point A of the start of contact with the beacon (transmission of the signal SA) and the point di of transmission of a location signal SLith by the ith subsystem, and the distance "after" Bdi, is defined as the distance between the point di of transmission of the location signal SLi and the point B of the end of contact with the beacon (transmission of the signal SB).

Unlike normal operation (FIG. 5A), in failing operation (FIG. 5B), the failing subsystem exhibits a strong dissymmetry between the "before" Adi and "after" Bdi distances, whereas the other two subsystems which are operating correctly, exhibit a more or less high degree of symmetry between these two distances.

This presupposes that the speed of the train is stabilized over the beacon. This represents a majority of the cases, given the inertia of a train and the small size of a beacon (approximately 50 cm).

Advantageously, the module 150 comprises a failure detection means 151 designed to compute a quantity relating to the dissymmetry from the safety location signal SLS, from the signals of start SA and of end SB of contact with the beacon and from the location signals SLi transmitted first in time by each of the subsystems. This means 151 generates an identification signal Sid of the failing subsystem when the ratio of the "before" Adi and "after" Bdi distances of the corresponding subsystem is, for example, outside of a predefined interval around the unity value, preferably [0.8:1.2].

THIRD EMBODIMENT

Figure 6:
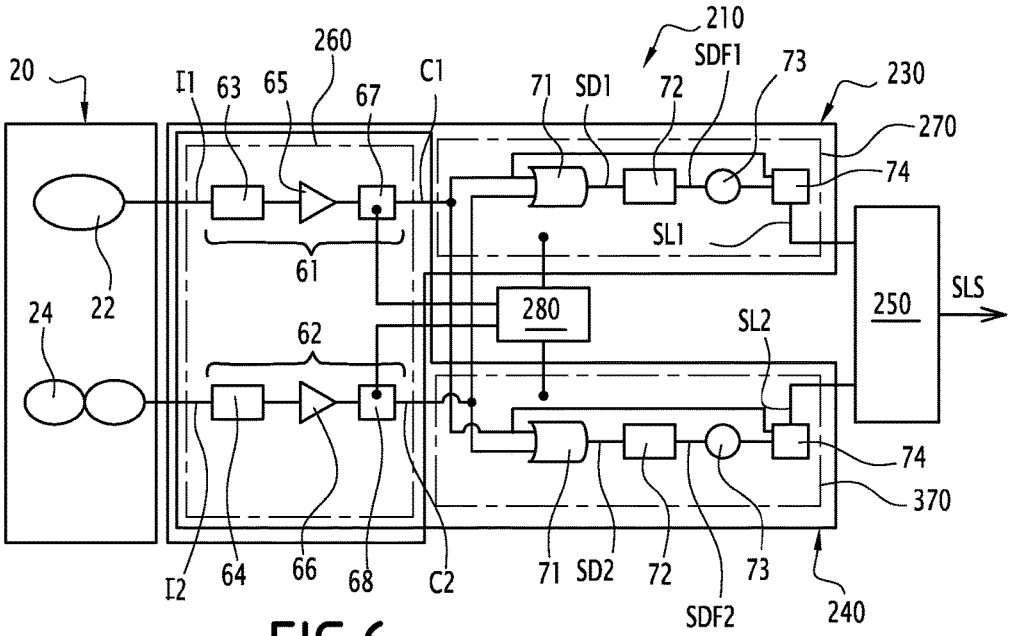
FIG. 6 represents a third embodiment of an embedded system for generating a location signal.
Figure 7:
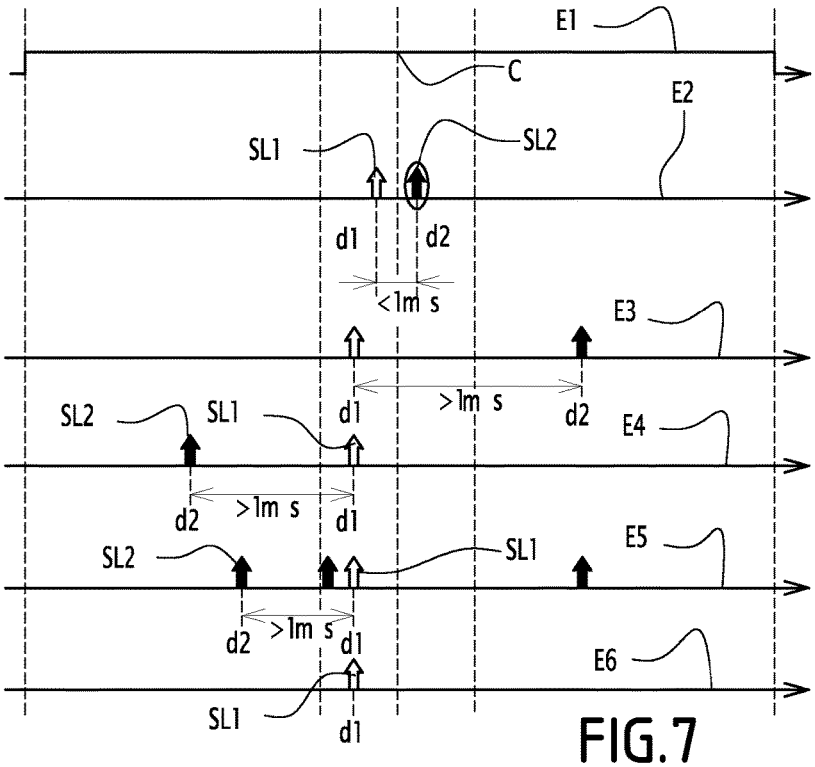
FIG. 7 represents a number of graphs illustrating the operation of a third arbitration algorithm implemented by the system of FIG. 6.

FIGS. 6 and 7 relate to a third embodiment of the system.

An element of FIG. 6 which is identical to an element of FIG. 1 is designated in FIG. 6 by the reference numeral used in FIG. 1 to designate this corresponding element.

As represented in FIG. 6, the system 210 according to this third embodiment comprises an antenna 20 comprising two loops, respectively simple 22 and in a FIG. 8, 24.

The system comprises a first processing subsystem 230 and a second processing subsystem 240.

The first subsystem 230 comprises an analog part 260 and a first digital part 270.

The second subsystem 240 comprises, as second analog part, the analog portion 260 of the first subsystem 230, and a second digital part 370 independent of the digital part 270 of the first subsystem 230.

In other words, the system 210 comprises an analog part 260 common to the first and second subsystems 230 and 240, a first digital part 270 specifically associated with the first subsystem 230 and a second digital part 370 specifically associated with the second subsystem 240.

The first and second digital parts are synchronized with each other by a suitable synchronization means 280 which delivers the same clock signal to the components 67, 68, 230 and 240.

The circuits and the components of the analog part 260 are identical to those represented in FIG. 1.

The circuits and the components of the first and second digital parts 270, 370 are identical to one another and to those represented in FIG. 1. The reference numerals have been reused accordingly.

The system 210 comprises an arbitration module 250 designed to generate a safety location signal SLS from, only, the first and second location signals SL1, SL2 transmitted respectively by each of the two subsystems 230 and 240.

A third algorithm, implemented by the arbitration module 250, consists in selecting, as safety location signal SLS, the location signal that arrived second in time out of the location signals SL1, SL2 transmitted first in time by each of the two processing subsystems 230 and 240, provided that the duration between the instants of transmission of the first and second signals SL1 and SL2 is less than the reference duration T0. This reference duration T0 is, for example, 1 μs. This represents 0.1 mm at 500 km/h.

As in the first embodiment, this algorithm relies on the fact that a subsystem which is operating correctly supplies a location signal at +/−2 cm from the center C of the beacon, this being guaranteed by the radiation patterns of the loops of the antenna.

This third algorithm is founded on the fact that the time difference between the instants of transmission of a location signal by two mutually independent subsystems depends in fact exclusively on the gain and on the signal/noise ratio of the analog part of each of these two subsystems.

Consequently, by using an analog part common to the two subsystems and by performing a synchronous processing in the digital parts, the duration separating the instants of transmission of the two location signals originating respectively from each of the two subsystems is bounded.

The synchronization time between the two digital parts produced by the synchronization means 280 defines the reference duration T0.

FIG. 7 combines a number of graphs illustrating the behavior of the third algorithm implemented by the module 250.

In these graphs, d1 represents the point at which the first processing subsystem 230 transmits, for the first time, a first location signal SL1; d2 represents the point at which the second processing subsystem 240 transmits, for the first time, a second location signal SL2.

The graph E1 represents the spatial interval within which the antenna detects the beacon. The geometrical center of the beacon is identified by the reference C.

The graph E2 illustrates a normal operation of the system 210. In this graph, the first signal SL1 arrives first in time, the second signal SL2 arrives second in time. The duration separating the first and second location signals is less than the reference duration T0. The module 250 selects, as safety location signal SLS, the second signal SL2.

For the subsequent graphs, the second subsystem 240 is failing. No safety location signal SL2 is then delivered by the system 210.

The graph E3 represents the case where the second signal SL2 arrives too late relative to the intrinsic functional accuracy of +/−2 cm relative to the point C.

The duration separating the first and second location signals SL1 and SL2 is greater than the reference duration T0. The module 250 then selects none of the location signals.

The graph E4 represents the case where the second signal SL2 arrives too early relative to the intrinsic functional accuracy. The duration separating the first and second location signals SL1 and SL2 is greater than the reference duration T0. The module 250 then selects none of the location signals.

The graph E5 represents the case where the second location signal SL2 is transmitted a number of times, the first time too early relative to the intrinsic functional accuracy. The duration separating the first and second location signals SL1 and SL2 is greater than the reference duration T0. The module 250 then selects none of the location signals.

The graph E6 represents the case where the second subsystem 240 delivers no second location signal. The module 250 transmits no safety location signal.

VARIANT EMBODIMENT (ANTENNA WITH 3 LOOPS)

As a variant, the first, second and third embodiments are adapted for operation with an antenna comprising three loops having mutually different radiation patterns, such as, for example, the antenna described in the document PCT/FR2010/050607. The person skilled in the art will know how to adapt the analog part of a processing subsystem for it to generate a location signal which takes account of the phases of the first, second and third currents induced in each of these three loops. In particular, the signal delivered by the third loop of the antenna makes it possible to avoid having to compare the signal delivered by the first loop against a threshold as is done in the variants of the system in which the antenna has two loops.

STUDY OF THE POSSIBLE FAILURES

A detailed analysis of the possible failures of the system has been carried out, so as to estimate the probability of the transmission of an incorrect safety location signal, with a view to the type approval of the system.

These possible failures are of three types:

According to a first type of failure, the loss of the generation of a digitized current Ci at the output of the ith analog circuit is translated into the application of a Gaussian white noise at the input of the digital part of the subsystem.

According to a second type of failure, the loss of the generation of a digitized current Ci at the output of the ith analog circuit is reflected in a cross torque, the ith circuit copying the digitized current Ck generated by another circuit. The currents Cith and Ck applied as input for the digital part of the subsystem are then strongly correlated.

According to a third type of failure, a systematic delay introduced by an analog circuit in the generation of the corresponding digitized current Ci.

To deal with these possible failures, in a first alternative of the system, it comprises a test means (not represented in the figures) designed to eliminate these possible failures of the analog part.

The test means is designed to periodically perform a test consisting in applying, at the input of each circuit, a reference current IiRef in place of the current Ii induced in the corresponding loop. This test consists then in analyzing, at the output of each circuit, the amplitude and the delay of the corresponding digitized current CiRef.

However, the periodic performance of a test presents two disadvantages:

for a failure of the third type, the delay can be meaningful only for a narrow frequency band which would not be detectable by the test because of the nature of the first and second reference currents injected;

the contact with the beacon can be affected if a test is carried out while the antenna is passing over the beacon and preventing the currents Ii generated by the antennas from being taken into account.

For these reasons, a second alternative of the system consists in blocking the transmission of the safety location signal SLS generated, when one or more additional conditions are not met.

To eliminate the failures of the first type, an additional condition consists in not taking into account the filtered phase difference signal SDF when it is situated within a predefined interval centered on the value 0.

The reason for this is that if, for example, the second digitized current C2 corresponds to a Gaussian white noise, its phase varies rapidly relative to that of the first digitized current C1, so that the phase difference SD1 or SD2 has the value −1 as often as +1. Thus, the time average of the phase difference between the first and second digitized currents performed by the filter 72 is close to the value 0.

It is demonstrated that the bounds of this interval depend not only on the safety level that is desired ($10^{-9}$ for the level SIL 4), but also on the sampling frequency of the filter 72 used. The values of the band of prohibited values of the hysteresis threshold comparator 73 are adapted accordingly.

For example, in the case of the third embodiment in its variant with two loops (FIG. 6), no safety location signal is transmitted by the module 250, when the filtered phase difference signal SDF1 or SDF2 is between −0.56 and +0.56 for a frequency of approximately 13 MHz, and between −0.28 and +0.28 for a frequency of approximately 55 MHz.

By rejecting the situations in which the filtered phase difference signal SDF1 or SDF2 is close to the value 0, the failures of the first type are eliminated.

The failures of the second type, for the variants of the system in which the antenna 10 comprises two loops, are immediately detected. In practice, they result in a filtered phase difference signal SDF1 or SDF2 equal to unity and do so throughout the contact between the antenna and the beacon. Since the comparator 73 identifies no variation of this signal, it transmits no signal. In this way, the failures of the second type are eliminated.

The failures of the second type (an analog circuit reproduces the most powerful signal out of the signals generated by the other two analog circuits, or reproduces the two signals generated by the other two analog circuits) can affect the variants of the system in which the antenna comprises three loops. To eliminate this type of failure, the arbitration module is adapted to implement an additional constraint consisting, after having left the contact with the beacon, in verifying that a sequence characteristic of the phase differences between the different pairs of induced currents has actually been observed. By default, the safety location signal transmitted while the antenna was in contact with the beacon will be invalidated.

However, to eliminate this type of failure and in order to avoid having to verify a constraint after the antenna has passed over the beacon, this verification therefore being able to be performed several seconds after the center of the antenna passes over the center of the beacon in particular in the case where the speed of the train is low, it is preferable to verify the constraint whereby the currents of the first and third loops of the antenna have less than 20 dB difference, which can be performed at the moment when the center of the antenna is located directly over the center of the beacon. In case of a positive verification the safety location signal is transmitted.

Finally, the study of the causes of the third type of failures shows that:

the amplifier 65, 66 can delay a signal only by a few microseconds, which leads to a location error of a few millimeters which is acceptable given the intrinsic functional accuracy of +/−2 cm relative to the center of the beacon;

the analog/digital converter 67, 68 can not delay a signal beyond a few clock cycles, i.e. less than a microsecond;

the filter 63, 64 can on its own delay the signal significantly.

However, it has been shown that a prejudicial delay given the intrinsic functional accuracy, for example a delay of the order of 350 μs, corresponds to a distance of 5 cm at 500 km/h, can be introduced only by a filter that has a particular structure, characterized by an extremely narrow bandwidth. Such a bandwidth requires the use of induction coils and/or capacitors for which the impedance is either very high or very low. It is then sufficient, in an upstream design phase of the filter 63, 64 to avoid these high or low impedances, to guarantee a sufficiently small delay and thereby reject, by construction, the failures of the third type.

To conclude, the proposed invention makes it possible:

to obtain location information with a high level of safety that complies with the level SIL 4;

to obtain an accuracy of this safety location signal of +/−2 cm with an antenna with two loops and of +/−2 cm with an antenna comprising three loops;

to not use the odometer to obtain an level SIL 4 safety location signal, and thus better adapt to a distributed traction (skidding and slipping of the wheels giving false odometer values);

to detect a latent failure of one of the subsystems.

The invention claimed is:

1. An embedded system for generating a rail vehicle location signal, of the type comprising:

an antenna comprising a first loop and a second loop having different respective radiation patterns, the first and second loops being respectively designed to generate first and second currents when the antenna passes over a suitable beacon, situated on a line at a known position; and, an electronic processing subsystem designed to generate a location signal from said first and second currents, said subsystem comprising:

a first electronic processing subsystem designed to generate a first location signal from said first and second currents, a second electronic processing subsystem designed to generate a second location signal from said first and second currents, and an arbitration module designed to generate a safety location signal according to said first and second location signals, wherein the first subsystem comprises a first analog part and a first digital part, wherein the second subsystem comprises, as a second analog part, said first analog part of the first subsystem, and a second digital part independent of said first digital part of the first subsystem, and wherein the arbitration module is further configured to select, as the safety location signal, the location signal that arrived second in time, provided that the duration separating the transmission of the location signals transmitted first in time by each of the subsystems is less than a reference duration.

2. The embedded system as claimed in claim 1, wherein said first and second subsystems are independent of one another.

3. The embedded system as claimed in claim 2, wherein said first and second subsystems comprise the same components.

4. The embedded system as claimed in claim 3, wherein the arbitration module is further configured to select, as the safety location signal, the signal that arrived second in time among the first location signal and the second location signal.

5. The embedded system as claimed in claim 3, wherein the arbitration module is further configured to receive as input a distance delivered by an odometer system with which said vehicle is equipped, and the arbitration module is further configured to select the one of the first location signal and the second location signal whose first reception arrives second in time if it arrives at a point which is at a distance from the point of transmission of a signal transmitted first in time less than a reference distance.

6. The embedded system as claimed in claim 5, wherein the antenna comprises a third loop, a radiation pattern of the third loop being different from the radiation patterns of the first loop and the second loop, said safety location signal making it possible to locate the vehicle relative to the known position of the beacon with an accuracy of −2/+7 cm.

7. The embedded system as claimed in claim 1, further comprising a third electronic processing subsystem designed to generate a third location signal from said first and second currents, wherein said arbitration module is further designed to select, as the safety location signal, a location signal of the first, second, and third location signals whose first reception arrives second in time out of the first, second and third location signals transmitted first in time by each of the first, second and third subsystems.

8. The embedded system as claimed in claim 7, wherein the arbitration module is designed to determine, for each of the subsystems, a "before" duration separating the instant of the start of detection of the beacon and the instant of transmission of the location signal transmitted first in time by the subsystem concerned, and an "after" duration separating the instant of transmission of the location signal transmitted first in time by the subsystem concerned and the instant of the end of detection of the beacon, and wherein the arbitration module is designed to identify the failure of a subsystem if a ratio of the "before" duration to the "after" duration is outside of a predetermined interval around a unity value.

9. The embedded system as claimed in claim 7, wherein the antenna further comprises a third loop, the radiation pattern of the third loop being different from the radiation patterns of the first loop and the second loop, and said safety location signal makes it possible to locate the vehicle relative to the known position of the beacon with an accuracy of +/−5 cm.

10. The embedded system as claimed in claim 1, wherein the second digital part of the second subsystem comprises the same components as the first digital part of the first subsystem.

11. The embedded system as claimed in claim 1, wherein each subsystem comprises an analog part and a digital part, and the system is further designed to apply a reference current to an input of an analog part of each of subsystem and to analyze digitized current signals generated at the output of said analog part.

12. The embedded system as claimed in claim 1, wherein the system complies with the safety level SIL 4.

13. A rail vehicle comprising an embedded system for generating a location signal, wherein said embedded system comprises:

an antenna comprising a first loop and a second loop having different respective radiation patterns, the first and second loops being respectively designed to generate first and second currents when the antenna passes over a suitable beacon, situated on a line at a known position; and, an electronic processing subsystem designed to generate a location signal from said first and second currents, said subsystem comprising:

a first electronic processing subsystem designed to generate a first location signal from said first and second currents, a second electronic processing subsystem designed to generate a second location signal from said first and second currents, and an arbitration module designed to generate a safety location signal according to said first and second location signals, wherein the first subsystem comprises a first analog part and a first digital part, wherein the second subsystem comprises, as a second analog part, said first analog part of the first subsystem, and a second digital part independent of said first digital part of the first subsystem, and wherein the arbitration module is further configured to select, as the safety location signal, the location signal that arrived second in time, provided that the duration separating the transmission of the location signals transmitted first in time by each of the subsystems is less than a reference duration.

14. A method for generating a rail vehicle location signal, comprising the steps consisting in:

generating first and second currents when an antenna passes over a suitable beacon, said antenna being embedded onboard the vehicle and comprising a first loop and a second loop having different respective radiation patterns, said beacon being situated on a line at a known position;

generating a first location signal from said first and second currents by means of a first processing subsystem;

generating a second location signal from said first and second currents by means of a second processing subsystem; and generating a safety location signal according to said first and second location signals, wherein the first subsystem comprises a first analog part and a first digital part, wherein the second subsystem comprises, as a second analog part, said first analog part of the first subsystem, and a second digital part independent of said first digital part of the first subsystem, and wherein the generating the safety location signal comprises selecting a second in time arriving one of said first and second location signals provided that the duration between the instances of transmission of the first and second signals is less than a predetermined reference duration.

15. The method as claimed in claim 14, wherein the generating the safety location signal comprises selecting the second in time arriving one of said first and second location signals provided that a distance separating the location signal that arrived second in time from a location signal that arrived first in time is less than a predetermined reference distance.

16. The method as claimed in claim 14, further comprising generating a third location signal from said first and second currents by means of a third processing subsystem, wherein the generating the safety location signal comprises selecting, as the safety location signal, a second in time arriving one of said first, second, and third location signals.

17. The method as claimed in claim 14, wherein the method further comprises verifying at least one additional condition making it possible to detect a failure of the analog part common to the first and second processing subsystems.

18. An embedded system for generating a rail vehicle location signal, of the type comprising:

an antenna comprising a first loop and a second loop having different respective radiation patterns, the first and second loops being respectively designed to generate first and second currents when the antenna passes over a suitable beacon, situated on a line at a known position; and, an electronic processing subsystem designed to generate a location signal from said first and second currents, said subsystem comprising:

a first electronic processing subsystem designed to generate a first location signal from said first and second currents, a second electronic processing subsystem designed to generate a second location signal from said first and second currents, and an arbitration module designed to generate a safety location signal according to said first and second location signals, wherein said first and second subsystems are independent of one another, wherein said first and second subsystems comprise the same components, wherein the arbitration module is further configured to receive as input a distance delivered by an odometer system with which said vehicle is equipped, and wherein the arbitration module is further configured to select the one of the first location signal and the second location signal whose first reception arrives second in time if it arrives at a point which is at a distance from the point of transmission of a signal transmitted first in time less than a reference distance.

19. A method for generating a rail vehicle location signal, comprising the steps consisting in:

generating first and second currents when an antenna passes over a suitable beacon, said antenna being embedded onboard the vehicle and comprising a first loop and a second loop having different respective radiation patterns, said beacon being situated on a line at a known position;

generating a first location signal from said first and second currents by means of a first processing subsystem;

generating a second location signal from said first and second currents by means of a second processing subsystem; and generating a safety location signal according to said first and second location signals, wherein the generating the safety location signal comprises selecting a second in time arriving one of said first and second location signals provided that a distance separating the location signal that arrived second in time from a location signal that arrived first in time is less than a predetermined reference distance.

20. An embedded system for generating a rail vehicle location signal, of the type comprising:

an antenna comprising a first loop and a second loop having different respective radiation patterns, the first and second loops being respectively designed to generate first and second currents when the antenna passes over a suitable beacon, situated on a line at a known position; and, an electronic processing subsystem designed to generate a location signal from said first and second currents, said subsystem comprising:

a first electronic processing subsystem designed to generate a first location signal from said first and second currents, a second electronic processing subsystem designed to generate a second location signal from said first and second currents, a third electronic processing subsystem designed to generate a third location signal from said first and second currents, an arbitration module designed to generate a safety location signal by selecting, as the safety location signal, a location signal of the first, second, and third location signals whose first reception arrives second in time out of the first, second and third location signals transmitted first in time by each of the first, second and third subsystems, wherein the arbitration module is designed to determine, for each of the subsystems, a "before" duration separating the instant of the start of detection of the beacon and the instant of transmission of the location signal transmitted first in time by the subsystem concerned, and an "after" duration separating the instant of transmission of the location signal transmitted first in time by the subsystem concerned and the instant of the end of detection of the beacon, and wherein the arbitration module is designed to identify the failure of a subsystem if a ratio of the "before" duration to the "after" duration is outside of a predetermined interval around a unity value.

21. A method for generating a rail vehicle location signal, comprising the steps consisting in:

generating first and second currents when an antenna passes over a suitable beacon, said antenna being embedded onboard the vehicle and comprising a first loop and a second loop having different respective radiation patterns, said beacon being situated on a line at a known position;

generating a first location signal from said first and second currents by means of a first processing subsystem;

generating a second location signal from said first and second currents by means of a second processing subsystem;

generating a third location signal from said first and second currents by means of a third processing subsystem;

generating a safety location signal by selecting, as the safety location signal, a location signal of the first, second, and third location signals whose first reception arrives second in time out of the first, second and third location signals transmitted first in time by each of the first, second and third subsystems;

determining, by an arbitration module, for each of the subsystems, a "before" duration separating the instant of the start of detection of the beacon and the instant of transmission of the location signal transmitted first in time by the subsystem concerned, and an "after" duration separating the instant of transmission of the location signal transmitted first in time by the subsystem concerned and the instant of the end of detection of the beacon; and identifying, if a ratio of the "before" duration to the "after" duration is outside of a predetermined interval around a unity value, the failure of a subsystem.

* * * * *